US007201028B1

(12) United States Patent
Gogel

(10) Patent No.: US 7,201,028 B1
(45) Date of Patent: Apr. 10, 2007

(54) STANCHION LEVER LOCK GUARD

(76) Inventor: Roy E. Gogel, Suite C-1, 319 Garlington Rd., Greenville, SC (US) 29615

( * ) Notice: Subject to any disclaimer, the term of this patent is extended or adjusted under 35 U.S.C. 154(b) by 0 days.

(21) Appl. No.: 11/605,979

(22) Filed: Nov. 29, 2006

Related U.S. Application Data

(63) Continuation of application No. 11/230,677, filed on Sep. 20, 2005.

(60) Provisional application No. 60/612,328, filed on Sep. 23, 2004.

(51) Int. Cl.
*E05B 67/38* (2006.01)

(52) U.S. Cl. ..... 70/56; 70/203; 70/212; 292/205; 292/218; 292/DIG. 32

(58) Field of Classification Search ..... 70/54–56, 70/DIG. 43, DIG. 56, 417, 202, 203, 211, 70/212; 292/148, 205, 218, 281, DIG. 32
See application file for complete search history.

(56) References Cited

U.S. PATENT DOCUMENTS 3,392,555 A * 7/1968 Beaver ..... 70/56
3,606,423 A * 9/1971 McCarthy ..... 292/148
3,744,280 A * 7/1973 Brown et al. ..... 70/54
3,808,847 A * 5/1974 Vesely ..... 70/18
3,828,591 A * 8/1974 Beaver ..... 70/56
4,106,315 A * 8/1978 Dohanyos ..... 70/56
4,566,296 A * 1/1986 Kochakis ..... 70/56
4,883,294 A * 11/1989 Goodspeed ..... 292/148
4,920,772 A * 5/1990 Denison ..... 70/53
4,972,689 A * 11/1990 Anderson ..... 70/56
5,168,258 A * 12/1992 Radke ..... 340/542
5,172,574 A * 12/1992 Perfetto ..... 70/56
5,477,710 A * 12/1995 Stefanutti ..... 70/56
5,946,952 A * 9/1999 Mintchenko ..... 70/2
6,009,731 A * 1/2000 Emmons et al. ..... 70/56
6,010,166 A * 1/2000 Hamilton et al. ..... 292/282
6,058,745 A * 5/2000 Sanchez ..... 70/56
6,357,266 B1 * 3/2002 Van Buren ..... 70/56
6,463,769 B1 * 10/2002 Garner ..... 70/56
6,494,064 B1 * 12/2002 Pena ..... 70/56
6,519,982 B1 * 2/2003 Brammall et al. ..... 70/56
6,581,419 B1 * 6/2003 Strodtman ..... 70/56
6,622,533 B1 * 9/2003 Santini ..... 70/56
6,668,601 B1 * 12/2003 Reddick ..... 70/56
6,928,843 B1 * 8/2005 Pirnie ..... 70/54
6,983,629 B1 * 1/2006 Gogel ..... 70/14
7,003,989 B2 * 2/2006 St. James ..... 70/56

* cited by examiner

*Primary Examiner*—Lloyd A. Gall
(74) *Attorney, Agent, or Firm*—Charles L. Schwab; Nexsen Pruet, LLC

(57) ABSTRACT

A lock guard is provided which is particularly well suited to protect a padlock employed to secure a stanchion lever securing one or more doors of a cargo container, trailer truck or moving van. The lock guard includes an interior locking tab with a vertical opening through which a hinged leg of a padlock shackle extends when the unhinged leg of the shackle is passed through an opening in a component of the stanchion door and the shackle is closed by abutting it against an abutment on the underside of the roof of the guard. The lock guard, which provides a protective housing or shield for the shackle of the padlock when the padlock is in its installed locking position, is particularly compact thereby minimizing access of cutting tools to the padlock shackle.

2 Claims, 5 Drawing Sheets

STANCHION LEVER LOCK GUARD

RELATED APPLICATIONS

This application is a continuation of U.S. patent Ser. No. 11/230,677 filed Sep. 20, 2005 for a Stanchion Lever Lock Guard. Applicant claims the benefit of United States of America provisional patent application Ser. No. 60/612,328 filed Sep. 23, 2004 for a Lock Guard.

BACKGROUND OF THE INVENTION

Thieves who break into moving vans, tractor trailers and other cargo containers use a variety of tools such as sledge hammers, acetylene cutting torches, saws, grinders and the like. The bolt cutter is a favored tool of burglars for cutting padlocks because of its portability. Thus there is a need to protect padlocks used on containers, moving vans, semi-trailers, truck trailer units. Tractor trailers with twin rear doors are secured by a pair of stanchions, at least one of which having an operating handle or lever, which is normally secured by a padlock to prevent rotation of the stanchion, thus maintaining the doors in a locked condition. Many moving vans have side doors, which are secured by stanchions. A recess with a locking tab is provided in each side door. The stanchion locking lever, in its locking position, is disposed within the recess with the locking tab extending through a slot in the lever. A padlock is customarily connected to the tab to prevent operation of the stanchion lever. It is also desirable to provide protection for padlocks securing side doors of moving vans.

U.S. Pat. Nos. 3,828,591 and 3,392,855 issued to Commodore E. Beaver show combined padlock and guard assemblies in which the shackle of a padlock is welded to the guard. Since the shackle is not free to move relative to the guard, the applicability of such an assembly to secure enclosures is limited. Different size guards would be needed for different size locks. There is no interchangeability between locks and guards. U.S. Pat. No. 6,622,533 issued to Jerre Dennis Santini for a Protective Enclosure for a Door Handle Retaining Assembly shows a lock guard with a lock capturing member to which the unhinged leg of a lock shackle is secured. In order to place the lock on the inside of the guard and to be in position to slide the end of the free or unhinged leg of the shackle into the opening in the lock capturing member sufficient distance must exist within the guard above the lock capturing member. The padlock's shackle in its open position is sufficiently longer than the shackle in its closed position, thus requiring incremental space be designed above the lock capturing member—additional space beyond the height of the shackle in the locked position—for the pre-insertion step. This is particularly necessary since Santini uses the lock's unhinged shackle which requires even more elevation above the lock capturing member than the hinged shackle and, due to the height differences, by design negates the use of the top wall during the operation to close and secure the shackle. Consequently, during installation of the padlock into the guard, the shackle can not physically reach the underside of the top wall of the guard to aid in closing the shackle and therefore sufficient space must be provided in the guard to permit one's hand, or a tool, to be placed within the guard to force the shackle to a closed position. This is necessitated by the requirement to apply pressure both from the shackle end and the case end while securing the shackle. Incrementally, this is even more space than the mere lock shackle's open distance dictates. These space requirements result in an excessively large guard affording undesired access by thieves' cutting tools.

SUMMARY OF THE INVENTION

This invention is directed to a lock guard, which prevents bolt cutters or the like from being employed to cut the shackle of a padlock. The lock guard has a top wall, a front wall, a pair of laterally opposite side walls and an interior wall or tab extending rearwardly from the front wall and between the side walls with an opening through which the hinged leg of a padlock shackle extends when the latter is in its installed locking position. The padlock is locked by pushing the case of the padlock upwardly thereby abutting the shackle against an abutment on the underside of the top wall to force the shackle to a closed position. In the installed position of the padlock the shackle is shielded by the top, front and side walls of the housing and only the key end of the padlock casing is exposed at the open bottom of the protective shell formed by the walls.

BRIEF DESCRIPTION OF THE DRAWINGS

Three embodiments of the invention are shown in the accompanying drawings, in which.

DETAILED DESCRIPTION OF THE INVENTION

Figure 1:
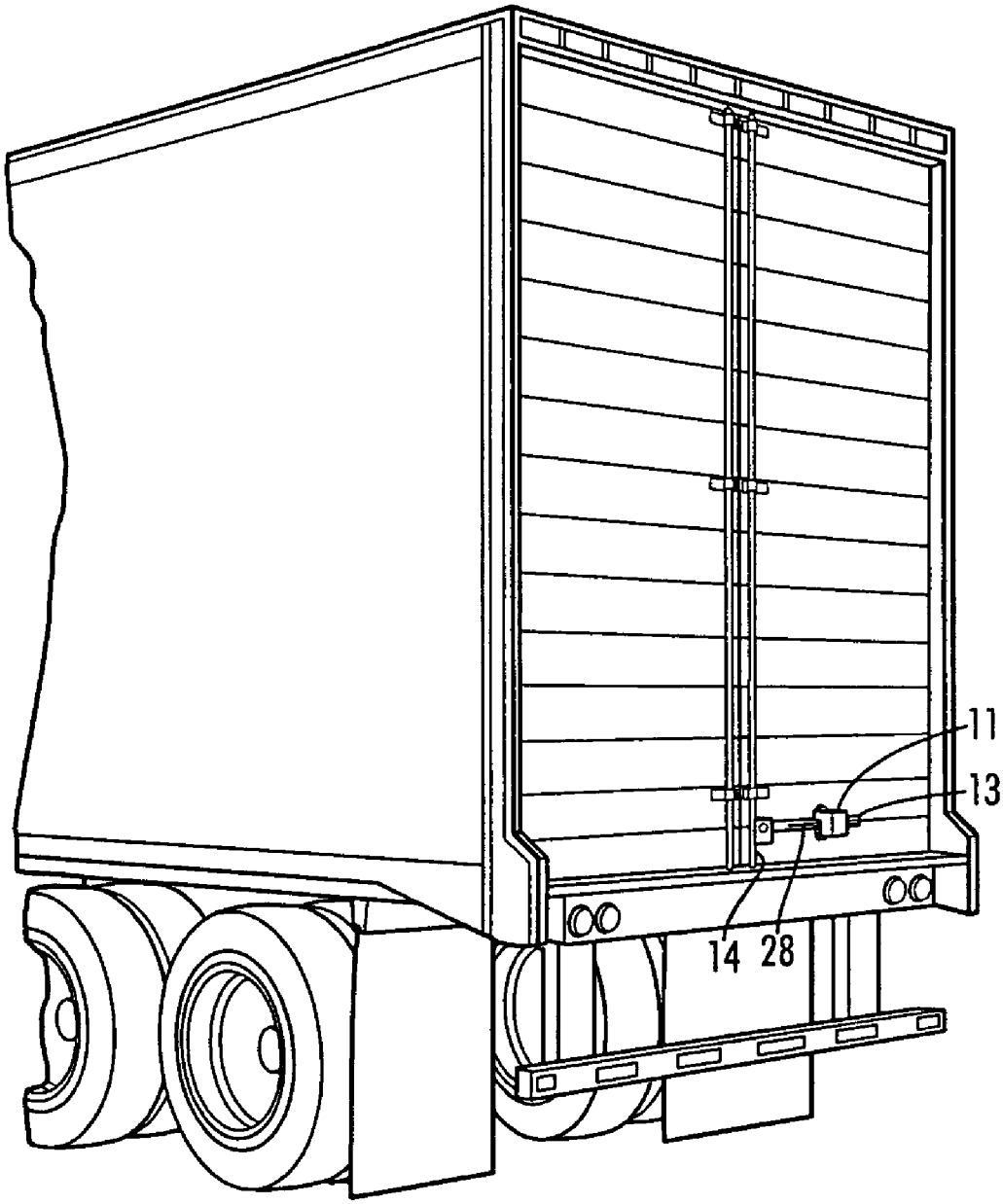
FIG. 1 is a perspective view of the rear end of a tractor-trailer with one embodiment of the lock guard protecting a padlock securing the operating lever of one of the locking stanchions.
Figure 3:
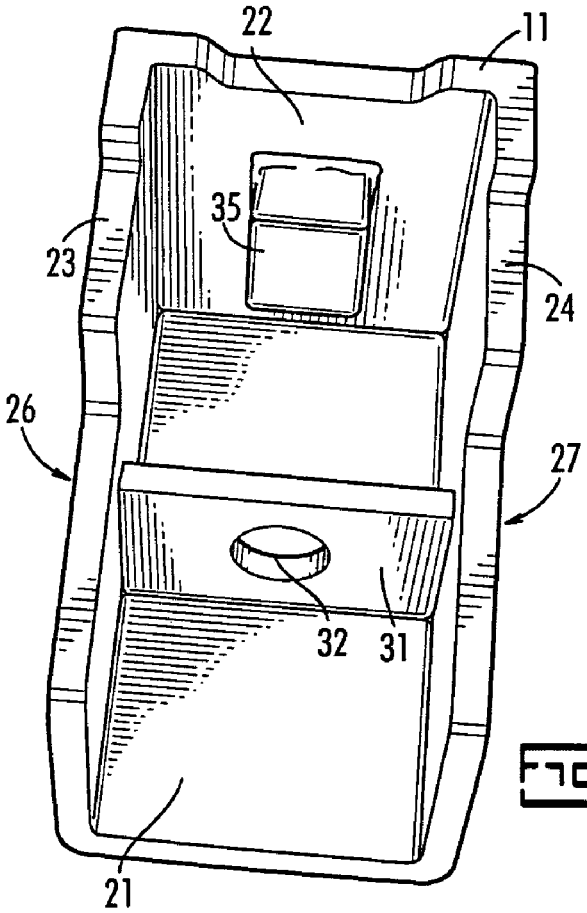
FIG. 3 is a perspective view of a second embodiment of the lock guard.
Figure 4:
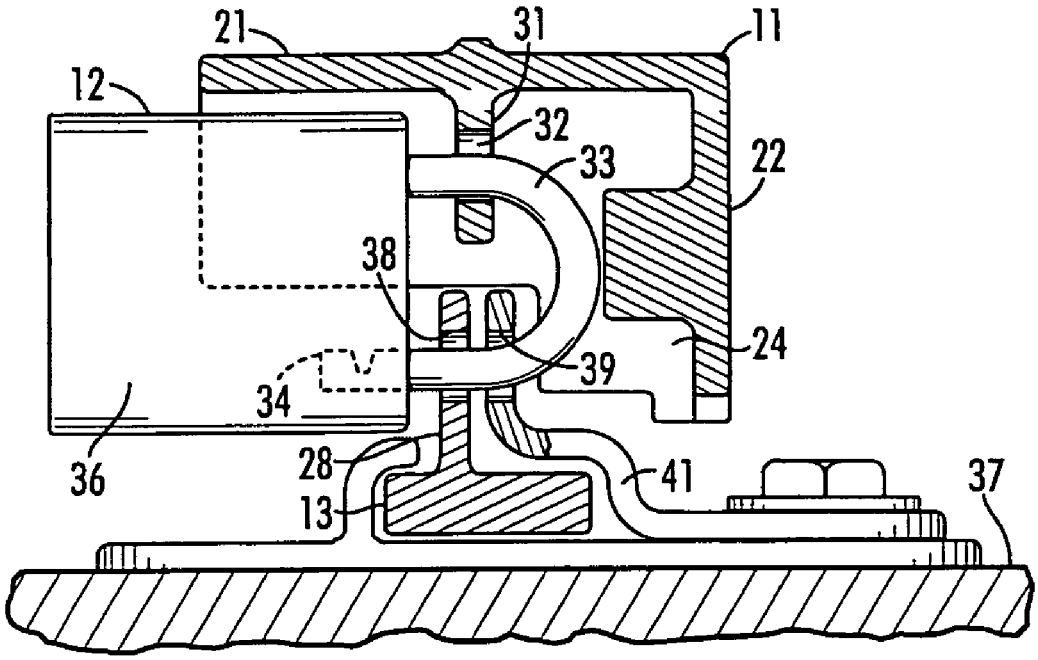
FIG. 4 is a section showing the lock guard of FIG. 3 applied to a padlock securing a stanchion operating lever having a right angle reinforcing ridge.

The lock guard 11 shown in FIGS. 1, 3 and 4 of the accompanying drawings is used with a padlock 12 securing the operating lever 13 of the stanchion 14 shown in FIGS. 1 and 4. The lock guard 11 is a box like structure without a bottom and one side wall. Referring to FIGS. 3 and 4 the lock guard includes a front wall 21, a top wall 22 and laterally opposite sides walls 23, 24. Notches 26, 27 are formed in the side wall 23 and the side wall 24, respectively, to accommodate the reinforcing ridge 28 on the stanchion operating lever 13. A retainer tab 31 is welded to the backside of the front 21 and extends therefrom parallel to the top wall 22. The tab 31 has an appropriately sized opening or bore 32 to accommodate the U shaped locking bar or shackle 33 of the padlock 12. A push block 35 protruding downwardly from the underside of the top wall 22 serves as an abutment when locking the padlock 12. When installing the padlock 12 and the lock guard 11, the padlock 12 is unlocked, in which condition the U shaped shackle 33 is extended from the case 36 of the lock 12 to an open position, not shown. The unhinged or distal end or leg 34 of the shackle 33 is passed through the opening 32 in the tab 31 of the lock guard 11. The lock guard 11 and padlock 12 are then moved toward the door 37 being secured and the unhinged leg 34 of the shackle 33 is passed through an opening 38 in the ridge 28 of the lever 13 and through an opening 39 in a pivotable connector component or keeper 41, shown in FIG. 4. At this point the hinged leg of the shackle 33 is in the opening 32 in the tab 31. The padlock 12 is then locked, as shown in FIG. 4, by placing the shackle 33 against the push block or abutment 35 and forcing the legs of the shackle into the case 36.

Figure 2:
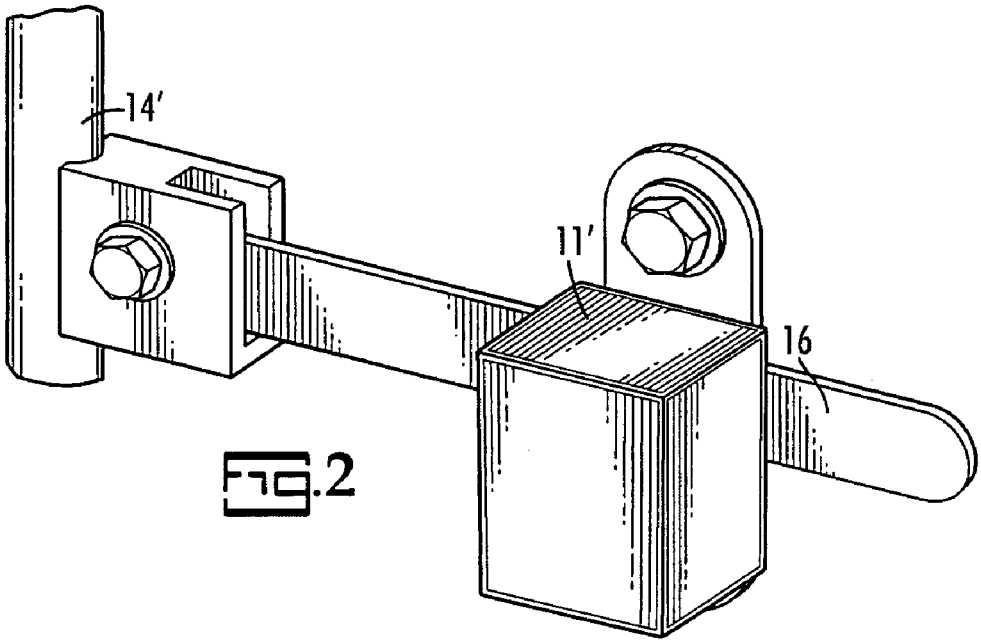
FIG. 2 is an enlarged perspective view of the stanchion operating handle and lock guard shown in FIG. 1.
Figure 5:
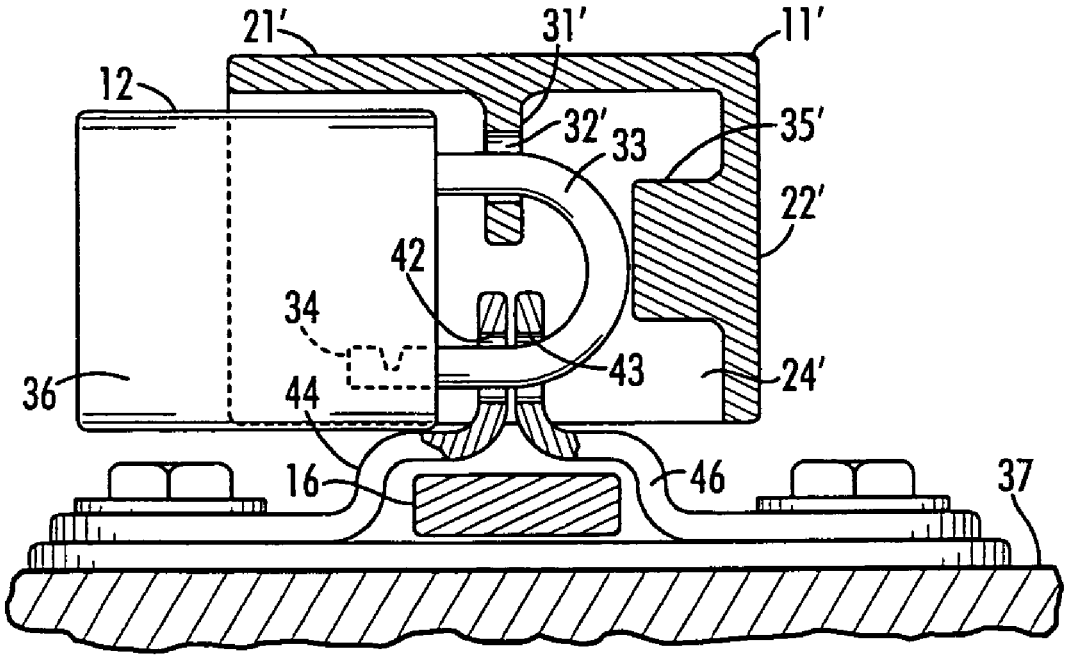
FIG. 5 is a section showing the lock guard of FIG. 2 applied to operating lever keepers.
Figure 6:
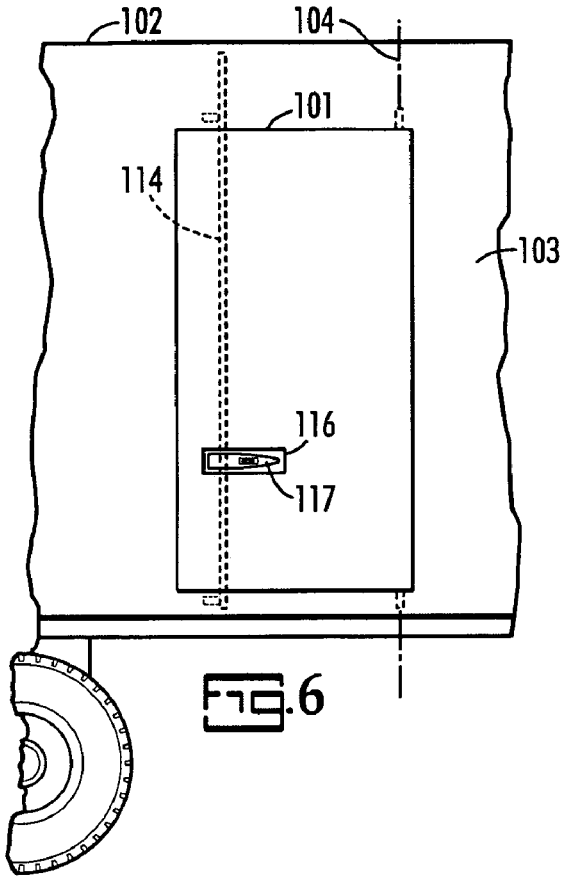
FIG. 6 is a side view of moving van showing a side door.
Figure 7:
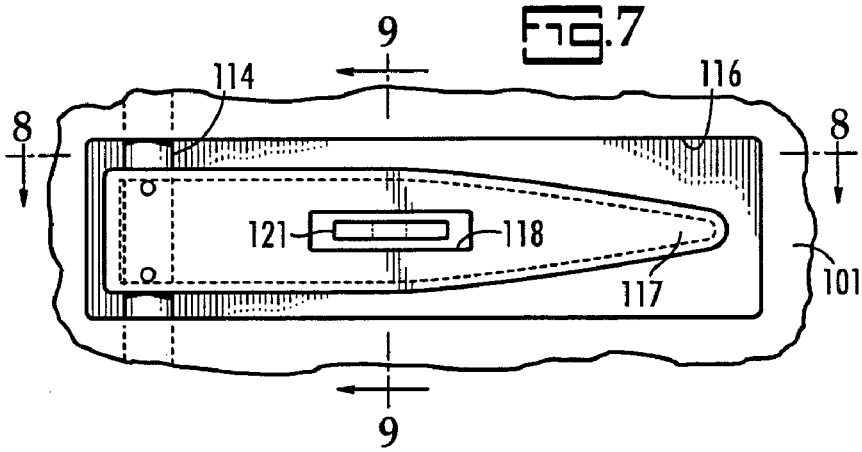
FIG. 7 is a side view of the stanchion locking lever for the side door shown in FIG. 6.
Figure 8:
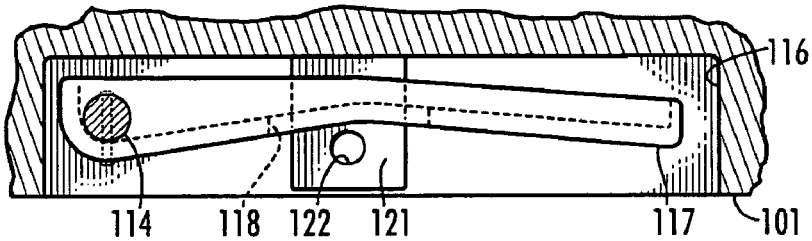
FIG. 8 is a view taken on line 8—8 in FIG. 7.
Figure 9:
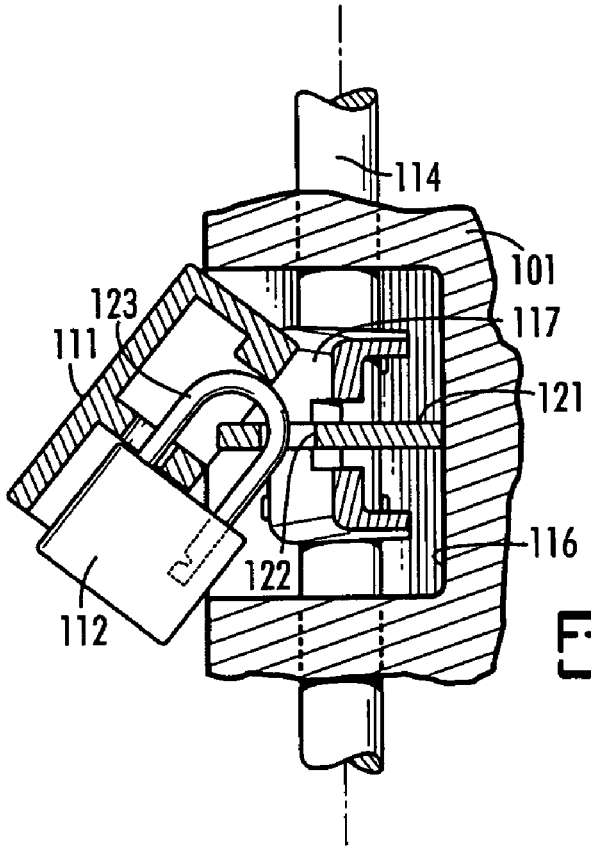
FIG. 9 is a section taken on line 9—9 in FIG. 7 with a third embodiment locking guard installed.

Some stanchion locking levers do not have a reinforcing ridge. Such a locking lever 16 is shown in FIG. 2 connected to stanchion 14'. A second embodiment lock guard 11', shown in FIGS. 2 and 5, is used to secure the locking lever 16. The lock guard 11' includes a top wall 22', a front wall 21', a tab 31' and a pair of side walls, only side wall 24' being illustrated. As shown in FIG. 5, the shackle 33 of the lock 12 is passed through opening 32' in the tab 31' and through aligned openings 42, 43 in pivotable connector components or keepers 44, 46.

FIGS. 6, 7, 8, 9 and 10 illustrate a side door 101 of a moving van 102 and a third embodiment lock guard 111 used to protect the padlock 112 securing the side door 101 in its closed position. One side of the side door 101 is hinged to the side wall 103 of the moving van 102 on a vertical axis 104. The side door 101 is releasably secured in its closed position by a vertically extending and rotatable stanchion 114 having latching fingers near its top and bottom ends. The stanchion 114 extends through one end of an elongated horizontal recess 116 in the door 101 and a stanchion operating lever 117 is rigidly secured to the stanchion 114. In the closed or locking position of the stanchion 114 shown in the drawings, the locking lever 117 is substantially disposed within the recess 116 and a connecter component 121 rigidly secured to the door 101 at the bottom of the recess 116 extends horizontally outward through a slot 118 in the lever 117. The portion of the connecter component 121 extending outward through the slot 118 has a vertical hole or opening 122 through which the shackle 123 of the padlock 112 extends. The operating lever 117 and the connecter component 121 are substantially disposed within the recess 116 in the locking position of the stanchion 114.

Figure 10:
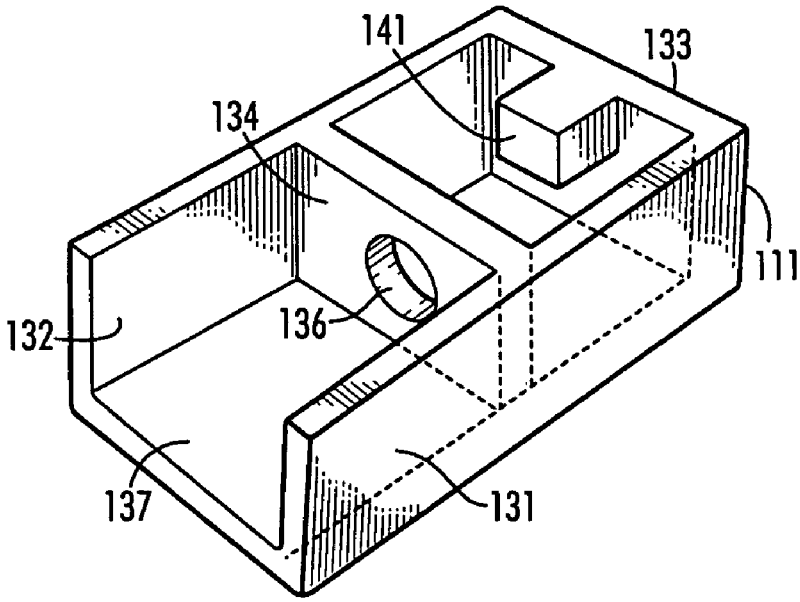
FIG. 10 is a perspective view of the locking guard shown in FIG. 9.

Referring to FIG. 10, the lock guard 111 has laterally opposite side walls 131, 132, and a top wall 133 of equal height. The side walls 131, 132 and the top wall 133 of the lock guard 111 are not as high as the corresponding walls of lock guard 11 and 11' because the tab 121 is substantially disposed within the recess 116. A retainer tab 134, which includes a shackle receiving opening 136, is welded to the side walls 131, 132 and the front wall 137 of the lock guard 11. An abutment 141, for engagement by the shackle 123 to aid in locking the padlock 112, is provided on the underside of the top wall 133. The lock guard 111 and the previously described lock guards 11 and 11' have compact structures with very limited internal access, thereby providing protection for the padlock against destruction by bolt cutters and other cutting tools at a reasonable cost.

What is claimed is:

1. A security device for releasably locking the operating lever of a vertically extending container door stanchion to a component of the container door having an opening adapted to receive the unhinged leg of a U shaped shackle of a padlock, comprising a lock guard including a top wall, a front wall, a pair of laterally spaced side walls, said top, front and side walls being rigidly interconnected to define a housing having an open rear and an open bottom and, a locking tab in the form of an interior wall extending laterally between and rigidly secured to said side walls and rigidly secured to and extending rearwardly from said front wall, said locking tab including a vertical opening adapted to receive said shackle of said padlock, and an abutment surface beneath said top wall, the spacing between said locking tab and said abutment surface permitting said padlock to be locked by abutting said shackle against said abutment surface, said lock guard permitting said unhinged leg of said shackle to pass sequentially through said opening in said locking tab and through said opening in said component of said container door and wherein said padlock is subsequently placed in a locked condition by engaging said shackle against said abutment surface, said lock guard being attached to said door only by said padlock and the hinged leg of said shackle being disposed in said opening in said locking tab when said padlock is in said locked condition.

2. The security device of claim 1 wherein said opening in said container door is a vertical opening.

* * * * *